US005560168A

United States Patent [19]

Gagne et al.

[11] Patent Number: 5,560,168

[45] Date of Patent: Oct. 1, 1996

[54] SWINGING DOOR WITH MIRROR INSERT ON ONE FACE AND METHOD OF MAKING SAME

[75] Inventors: Robert J. Gagne, Glastonbury; William J. Plein, II, South Windsor, both of Conn.; Kenneth R. Carson, Shannon, Miss.

[73] Assignee: The Stanley Works, New Britain, Conn.

[21] Appl. No.: 402,003

[22] Filed: Mar. 10, 1995

[51] Int. Cl.[6] ..... E06B 5/00; E06B 3/54; A47G 1/00

[52] U.S. Cl. ..... 52/455; 52/476; 52/745.15; 52/784.1; 52/785.1; 248/488; 312/227; 359/871

[58] Field of Search ..... 52/455, 747.1, 52/746.1, 745.1, 784.1, 784.16, 785.1, 799.11, 475.1, 476, 764, 769, 770, 773, 780, 745.15; 359/847, 848, 871, 879; 312/224, 225, 226, 227; 248/488; 49/70

[56] References Cited

U.S. PATENT DOCUMENTS

| | | | |
|---|---|---|---|
| 100,663 | 3/1870 | Pierce . | |
| 840,347 | 1/1907 | Knapp | 312/224 |
| 992,393 | 5/1911 | Tyler | 52/769 |
| 1,721,953 | 7/1929 | Hendrickson et al. . | |
| 1,750,366 | 3/1930 | Smith | 312/227 X |
| 1,813,162 | 7/1931 | Hoegger | 52/764 X |
| 2,166,430 | 7/1939 | Green | 49/70 |
| 2,807,192 | 9/1957 | Von Berg | 312/227 X |
| 2,833,004 | 5/1958 | Johnson et al. | D25/48 X |
| 3,731,443 | 5/1973 | Zaroor | 52/455 X |
| 3,760,543 | 9/1973 | McAllister . | |
| 3,903,669 | 9/1975 | Pease, Jr. et al. | 52/455 |
| 4,335,552 | 6/1982 | Blanchett et al. | 52/202 |
| 4,624,094 | 11/1986 | Schwindt | 52/785.1 |
| 4,763,444 | 8/1988 | Ritchie . | |
| 4,811,538 | 3/1989 | Lehnert et al. | 52/455 |
| 5,022,206 | 6/1991 | Schield et al. | 52/455 |
| 5,052,163 | 10/1991 | Czekala | 52/773 X |
| 5,265,388 | 11/1993 | Sherwood | 52/764 X |
| 5,269,111 | 12/1993 | McDougall . | |
| 5,325,648 | 7/1994 | Ménard | 52/455 X |
| 5,483,386 | 1/1996 | Carson | 359/879 X |

*Primary Examiner*—Wynn E. Wood
*Assistant Examiner*—Laura A. Saladino
*Attorney, Agent, or Firm*—Pepe & Hazard

[57] ABSTRACT

A hollow core door has a perimeter frame with stiles and top and bottom rails, and a pair of skins secured to the perimeter frame. One skin has an aperture therein with its side margins spaced inwardly of the perimeter frame, and inner frame elements are disposed between the margins of the aperture and the stiles, secured to at least one skin. A mirror with dimensions smaller than those of the aperture is secured in a molding which extends about its periphery of the mirror, and the molding has a peripheral portion overlying the skin about the side margins of the aperture and a body portion which extends inwardly of the door. The molding is secured against the skin.

15 Claims, 4 Drawing Sheets

SWINGING DOOR WITH MIRROR INSERT ON ONE FACE AND METHOD OF MAKING SAME

BACKGROUND OF THE INVENTION

The present invention relates to mirrored doors and more particularly, to a hollow core door having a mirror in one face thereof.

Mirrored doors are fairly widely employed in interior construction within homes and in some commercial installations. Some mirrored doors for closets comprise mirror panels which are mounted in a peripheral frame to slide back and forth in suitable track. In some instances, framed mirrors are secured to the surface of wood doors by various types of fasteners. Recently, there have been produced swinging doors which include a mirrored face and a wood face which is panelled or otherwise fabricated to provide desired surface ornamentation in one side of the door opening when closed.

Although it is possible to specially fabricate hollow core doors with frames to receive mirrors or a framed mirror, such specially manufactured hollow core doors would generally entail greater costs than conventional hollow core doors since they would be special products. Moreover, utilizing specially fabricated doors for the mounting of mirrors would minimize the diversity of mirror configurations and sizes which might otherwise be available since many different types of hollow core doors are fabricated for various door openings.

Accordingly, it is an object of the present invention to provide a novel hollow core door with a mirror in one face thereof.

It is also an object to provide such a door which may utilize a standard hollow core door construction modified to mount a framed mirror within an aperture formed in one face thereof.

Another object is to provide such a hollow core door in which the mirror is securely supported within the body of the door.

A further object is to provide a novel and facile method for making such a mirrored hollow core door.

SUMMARY OF THE INVENTION

It has now been found that the foregoing and related objects may be readily attained in a hollow core door with a mirror in one face thereof. The assembly includes a hollow core door having a perimeter frame with stiles and top and bottom rails, and a pair of skins secured to the perimeter frame and providing opposite faces of the door. One of the skins has an aperture therein with its side margins spaced inwardly of the perimeter frame. Elongated inner frame elements extend between the skins and are in the spacing disposed between the margins of the aperture and the stiles, and are secured to at least one of the skins. A mirror cooperatively configured with respect to the aperture has dimensions smaller than those of the aperture, and a molding extends about the periphery of the mirror and retains the mirror therein. The molding has a peripheral portion overlying the one skin about the side margins of the aperture and a body portion extending inwardly of the one skin, and the molding is secured against the one skin.

Preferably, there is included spacer means disposed between the mirror and the other of the skins, and the spacer means is secured to the inner surface of the other skin.

Desirably, the inner frame elements are adhesively bonded to at least one of the skins, and the inner frame elements include stiffening members extending longitudinally thereof.

Preferably, the means securing the molding against the one skin includes adhesive, and there is included adhesive between the molding and the mirror securing them in assembly. The molding may have resiliently deflectable clips on the body thereof which extend outwardly of its periphery behind the skin and bear upon its inner surface. The peripheral portion of the molding has a shoulder on its inner surface which abuts the skin, and a channel intermediate its width is desirably provided into which adhesive may flow.

There may also be included means securing the molding to the inner frame elements such as elongated fasteners extending through the molding and into the inner frame elements.

The molding may have a channel extending about the inner periphery of its body portion in which the peripheral portion of the mirror is seated.

A retrofit kit for mounting a mirror in an aperture cut in one skin of a hollow core door includes a pair of elongated inner frame elements dimensioned to seat snugly between the skins of the door and against the stiles thereof, these elements are of a width to space them adjacent but inwardly from the margins of the aperture. A mirror is secured in a molding extending about its periphery and the molding has a peripheral portion configured to overlie the one skin about the side margins of the aperture and a body portion dimensioned to extend inwardly of the door. Means is provided for securing the molding against the skin of the door, and there is included a spacer adapted to be mounted on the inner surface of the other skin of the door to provide a support for the rear surface of the mirror.

To assemble the mirror onto the door, the door is provided with an aperture cut in one of its skins, and the elongated inner frame elements secured between the skins adjacent the margins of the aperture. A spacer member is mounted on the other of the skins within the margins of the aperture. The mirror is secured in the molding, and the molding and mirror are placed in the aperture, and the molding is secured against the skin of a door.

Conveniently, the step of securing the molding in the aperture includes providing an adhesive between an inner shoulder the peripheral portion and the one skin, and it may additionally include driving elongated fasteners through the molding and into the elongated frame elements.

DETAILED DESCRIPTION OF THE PREFERRED EMBODIMENTS

Figure 1:
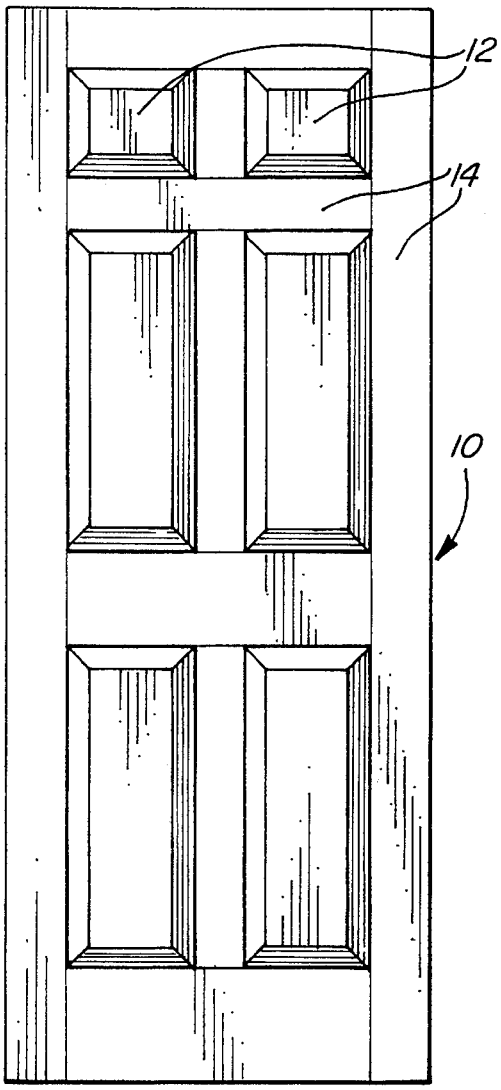
FIG. 1 is a front elevational view of the paneled face of a hollow core door embodying the present invention.
Figure 2:
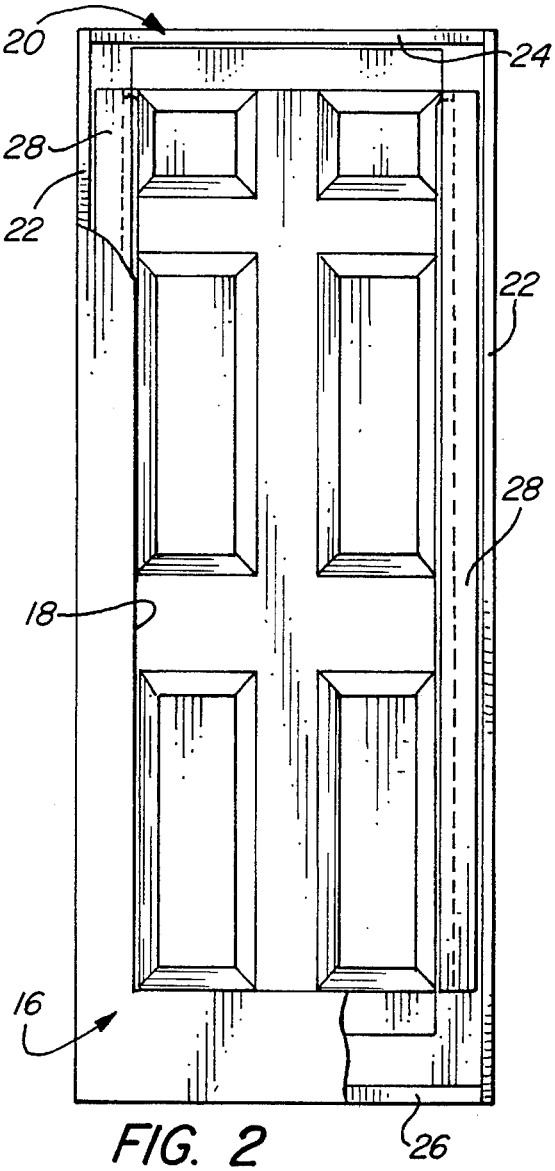
FIG. 2 is a rear elevational view of the door of FIG. 1 prior to insertion of the mirror assembly and with the rear flush face broken away to show the reinforcing frame elements in place.
Figure 4:
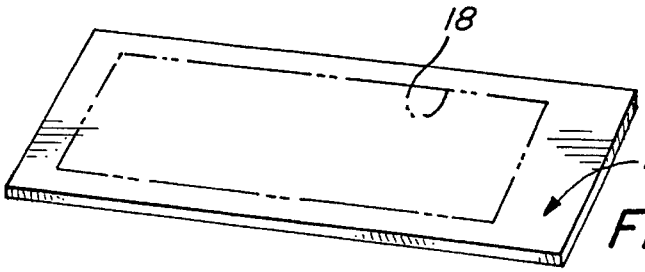
FIG. 4 is a perspective view of the flush face of the door with a phantom line showing the cutout to be made therein.
Figure 5:
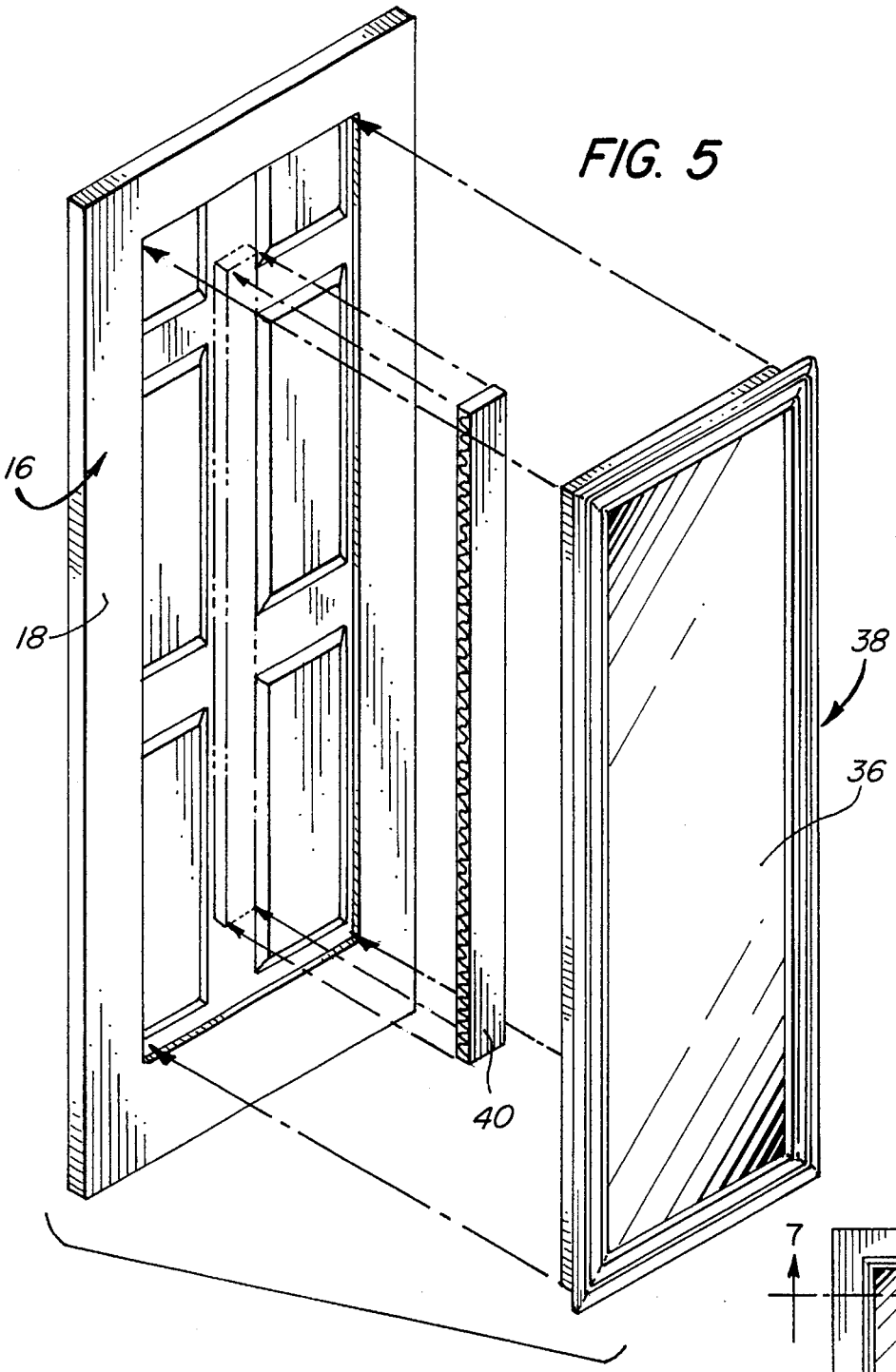
FIG. 5 is a partially exploded view of a door embodying the present invention.
Figure 6:
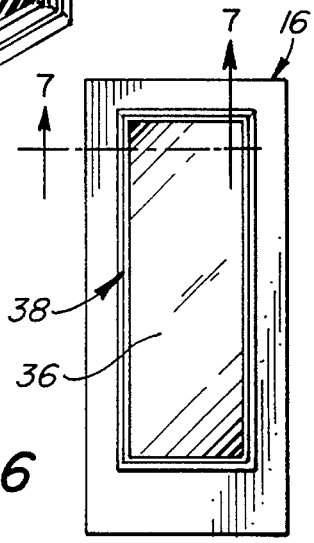
FIG. 6 is a rear elevational view of the assembled mirrored door drawn to a reduced scale.

In FIGS. 1 and 2 is illustrated a hollow core door having a decorative face provided by a first skin generally designated by the numeral 10 and formed with a multiplicity of recessed panels 12 and planar portions 14. The opposite face is provided by a flush surface skin generally designated by the numeral 16 and which has been provided with an aperture 18. The cutout is indicated by the phantom line 18 in FIG. 4. As is conventional construction, the door has a perimeter frame generally designated by the numeral 20 and provided by relatively narrow stiles 22 and top and bottom rails 24, 26 respectively. Not shown is a block provided along one of the stiles 22 to seat the handle and latch assembly.

Figure 3:
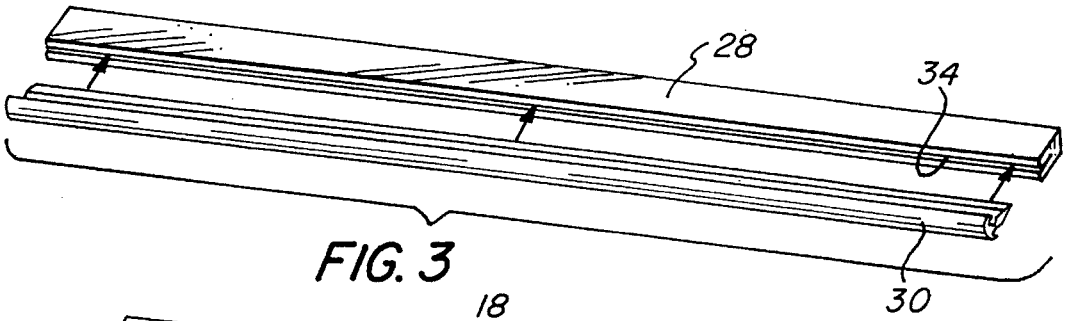
FIG. 3 is a perspective view of a reinforcing frame element with the stiffening element shown prior to insertion thereinto.
Figure 8:
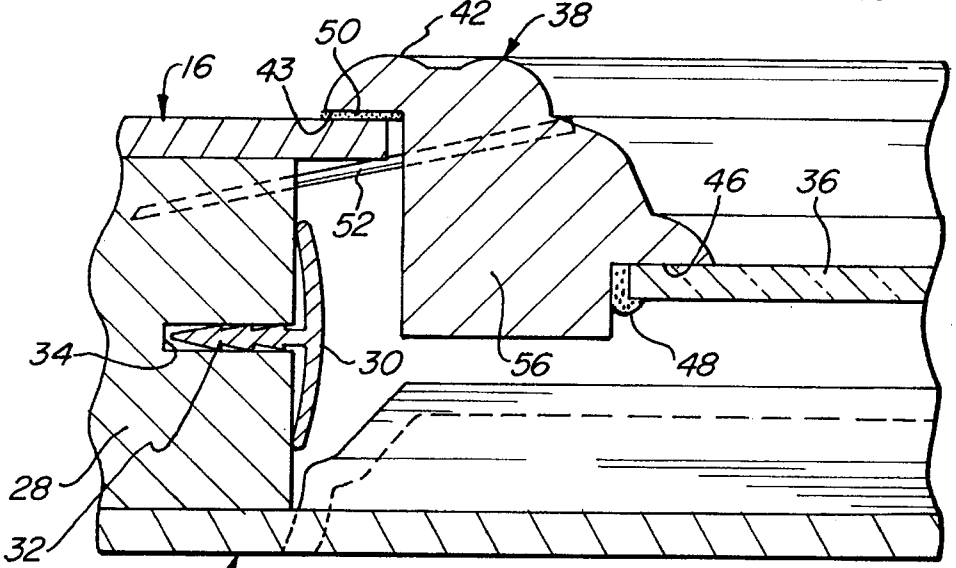
FIG. 8 is a further enlarged portion of sectional view of FIG. 7.
Figure 9:
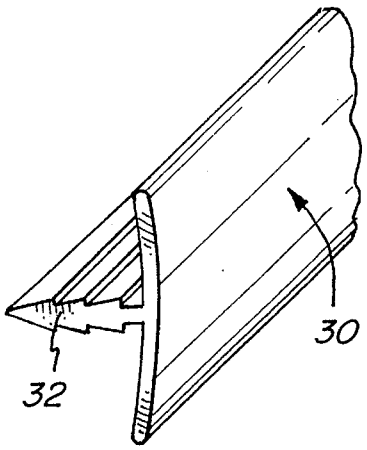
FIG. 9 is a fragmentary perspective view of the reinforcing strip drawn to an enlarged scale.

To increase the strength of the door and facilitate mounting of the mirror assembly, elongated inner frame elements 28 are disposed adjacent the stiles 22 and secured to the skins and stiles by adhesive (not shown). As seen in FIGS. 3, 8 and 9, they in turn are stiffened by the metallic stiffeners 30 which have barbed tails 32 seated in the longitudinally extending slots or channels 34 therein.

Seated in the aperture 18 is a mirror assembly comprised of the mirror 36 and the molding generally designated by the numeral 38 which extends about its periphery. An elongated spacer 40 is disposed on the inner surface of the skin 10 to provide support for the mirror 36 and to cushion it in the event of impact upon the door.

Figure 7:
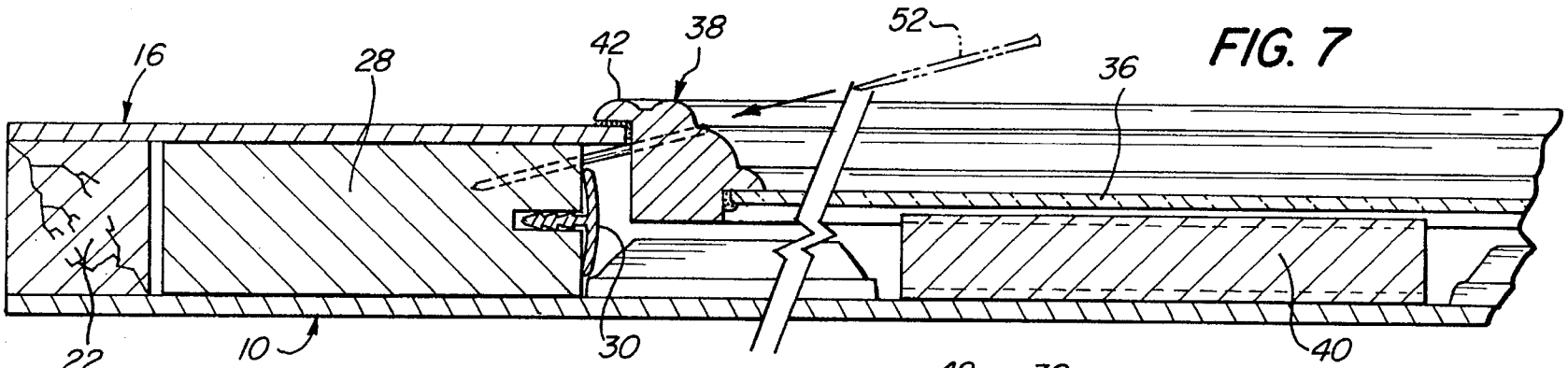
FIG. 7 is a fragmentary sectional view of the door along the line 7—7 of FIG. 6 and drawn to an enlarged scale.

As best seen in FIGS. 7 and 8, the molding 38 has a peripheral portion 42 which provides a shoulder 43 which overlies the margins of the skin 16 about the aperture 18. The body portion 44 has a recessed portion at its inner end providing a shoulder 46 against which is seated the peripheral portion of the mirror 36. An adhesive compound 48 secures the mirror 36 to the molding 38.

The peripheral portion 42 of the molding 38 in turn is secured to the skin 16 by the adhesive 50. To secure the bonding while the adhesive 50 cures and to increase the security of the assembly, elongated finishing nails 52 MAY BE driven diagonally through the molding 38 and into the inner frame elements 28.

Figure 10:
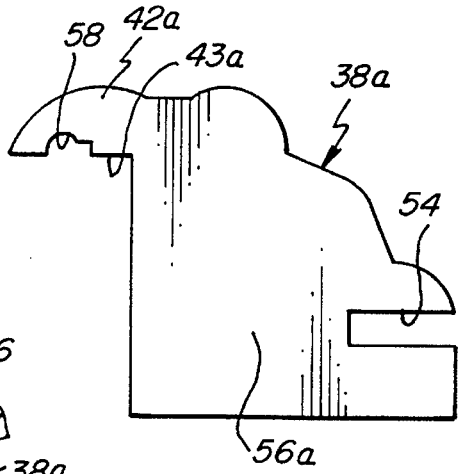
FIG. 10 is an end elevational view of an alternate molding providing a channel for seating the mirror.

In FIG. 10 there is illustrated a preferred embodiment of the molding **38*a* which has a channel 54 in the inner periphery of the body portion 56 and a channel or groove 58 intermediate the width of the shoulder 43*a*** into which excess adhesive may flow.

Figure 11:
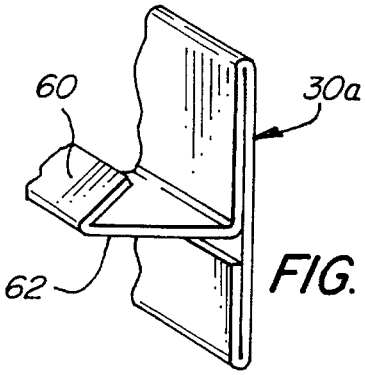
FIG. 11 is a fragmentary perspective view of an alternate stiffening member.

In FIG. 11, there is illustrated an alternate stiffener **30*a* which is readily formed from steel strip with a deflectable tab 60 on its leg 62 which will firmly lock in the channel or slot 34 of the inner frame elements 28**.

Figure 12:
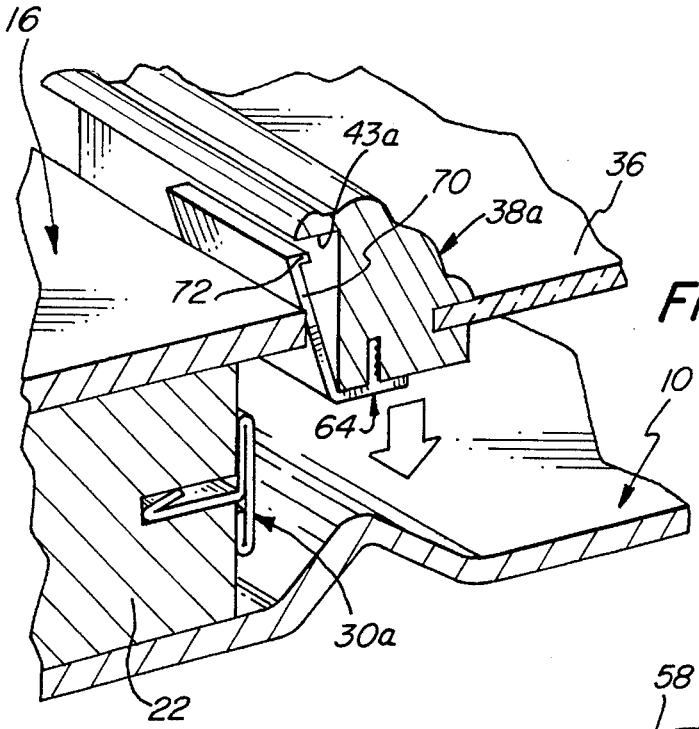
FIG. 12 is a fragmentary perspective view of the molding and mirror assembly being inserted into the aperture in the skin showing a deflectable clip deflecting.
Figure 13:
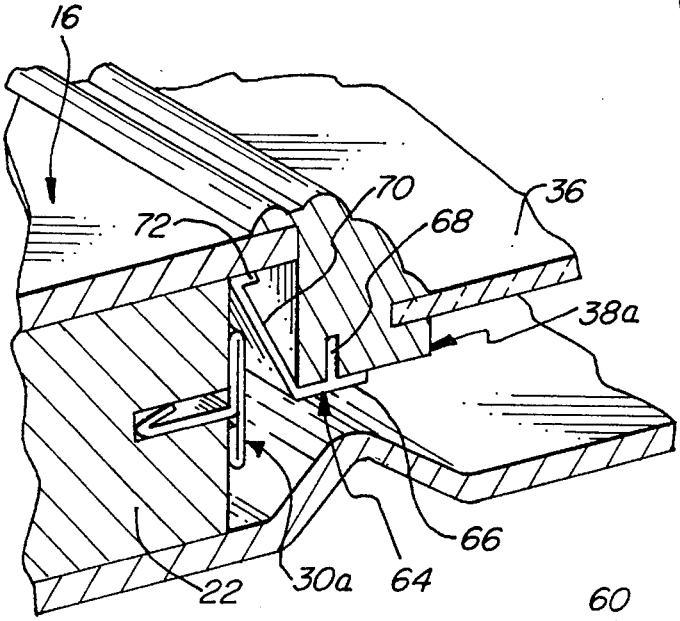
FIG. 13 is a similar view with the molding seated against the skin and the clip bearing upon the inner surface thereof.

FIGS. 12 and 13 show a preferred construction for the molding/mirror assembly which includes deflectable spring clips generally designated by the numeral 64 spaced about the periphery of the molding **38*a*. The clip 64 has a base portion 66 with a leg 68 which is seated in the body portion 56. It also has a deflectable arm portion 70 with an inturned flange 72 at its free end. When the molding/mirror assembly is moved inwardly of the aperture 18, the arm portion 70 deflects as seen in FIG. 12. When the assembly is fully seated, the arm portion 70 springs outwardly and bears against the inner surface of the skin 16**.

As will be readily appreciated, the hollow core door utilized in the present invention may be one which has been fully fabricated with similar skins on both sides or a decorative skin (e.g., a paneled skin) on one side and a planar skin on the other side in which the mirror assembly will be mounted. The skin in which the mirror is to be mounted may be cut in the finished door assembly to provide the desired aperture. The hollow core door manufacturer may also insert the inner frame elements before assembling one skin, and the manufacturer could also use a precut skin for the skin in which the mirror is to be mounted since these modifications in procedure would not unduly interfere with the normal manufacturing operation.

Whatever the case, the method of the present invention involves the placement and securing of the inner frame elements between the skins. The frame elements are coated with adhesive on the two faces to be disposed adjacent the skins, and if an edge will abut the stile, adhesive may also be coated on that edge.

The inner frame elements are generally fabricated from wood although metal, plastic and laminates may also be used if sufficiently rigid. Because the illustrated wooden frame elements are relatively thin and the principal purpose of the frame elements is to minimize warpage of the door, they are desirably stiffened by the insertion of rigid stiffeners fabricated from metal or a rigid plastic. The frame elements are premilled to provide a slot in which the tail or leg of the stiffener is inserted, and it is conveniently secured within the milled slot or channel by barbs or deflectable tabs which frictionally engage therewithin. Alternative mounting arrangements may be employed.

The next step is to mount the spacer on the inside surface of the other skin by a layer of adhesive. Although more than one spacer may be utilized, it has been found that a single elongated spacer is normally sufficient to provide the desired backing to limit deflection and absorb impacts upon the mirror.

The spacer may be fabricated from various materials including corrugated board, synthetic resin foam, honeycomb structures and the like. The material should be resiliently deflectable and desirably has high damping characteristics so that it will absorb both impact forces on the mirror and vibrations which might be induced in the mirror. It is not essential that the spacer abut the rear surface of the mirror in its at rest position, but it should be spaced closely adjacent thereto so to provide the desired cushioning effect.

The several elements of the molding are also assembled by use of adhesive to bond the ends thereof and brads or corrugated staples may be added to increase the security of that assembly. The mirror is then seated against the shoulder of the molding and secured in place by a bead of a flexible adhesive compound. In the preferred molding construction, the molding has a channel in its inner surface to seat the mirror, and it may also use adhesive. After the adhesive compound has cured sufficiently to provide firm retention of the mirror in the molding, the molding is then coated with adhesive adjacent the juncture of the inner shoulder on its peripheral portion with the body portion. When this adhesively coated molding is placed within the aperture, the adhesive comes into contact with the marginal portions of the skin about the aperture and flows outwardly along the shoulder under pressure. In the preferred embodiment excess adhesive will flow into a groove formed in the shoulder. In addition, adhesive and spring clips may be provided to enhance the engagement. Although the adhesive (and spring clips) will normally provide a sufficient bond to the skin to securely mount the mirror assembly thereon, elongated brads may be driven diagonally through the molding and into the inner frame elements 28 to provide additional security to the assembly during the curing of the adhesive.

As will be appreciated, the configuration and dimensions of the mirror assembly may vary widely, and the cutout or aperture in the door skin is cooperatively configured and dimensioned to provide a small clearance about the molding. It is not essential that the inner frame elements be disposed closely adjacent the stiles of the perimeter frame, but they should be of sufficient length and well bonded to the skins so that they will provide stiffness to the door in which the mirror frame assembly is placed to resist warpage of the door.

Various types of adhesives may be utilized to effect the bonding of the mirror to the molding, and of the molding to the door skins. For bonding the mirror to the molding, a flexible pressure-sensitive, hot melt adhesive has been found highly effective. It is easily applied to the surface of the molding as a bead by a pressurized nozzle, and it provides a high strength bond quickly.

To bond the mirror molding to the skin, a hot melt adhesive is desirably used. This is preferably a high solids, moisture-curing hot melt adhesive which provides very high green strength and a very fast setting speed. It is applied as a bead to the molding before it is seated in the aperture of the skin. After the molding and mirror are seated in the aperture, pressure is applied to the assembly by passing it through a roll nip, or by a platen, or by clamping. This adhesive may also be used to bond the spacer to the skin.

Thus, it can be seen from the foregoing detailed specification and claims that the mirrored door of the present invention is one which may be fabricated readily to provide an attractive assembly in which the mirror is firmly supported within a hollow core door. The configuration of the mirror and its frame and their dimensions may be varied for the particular application, and the assembly may be effected by a homeowner through provision of a retrofit kit containing the necessary elements and the appropriate instructions.

Having thus described the invention, what is claimed is:

1. A hollow core door with a mirror in one face thereof comprising:

(a) a hollow core door having a perimeter frame with stiles and top and bottom rails, and a pair of skins secured to said perimeter frame and providing opposite faces of said door, one of said skins having an aperture therein with its side margins spaced inwardly of said perimeter frame and the other of said skins providing a continuous surface;

(b) elongated inner frame elements extending between said skins in the spacing between the margins of said aperture and said stiles, said inner frame elements being adhesively bonded to at least one of said skins;

(c) a mirror cooperatively configured with respect to said aperture and having dimensions smaller than those of said aperture;

(d) a molding extending about the periphery of said mirror and retaining said mirror therein, said molding having a peripheral portion overlying the outer surface of said one skin about the side margins of said aperture and a body portion extending inwardly of said one skin;

(e) means securing said molding against said one skin; and (f) spacer means disposed between said mirror and said other skin of said pair of skins.

2. The mirrored door in accordance with claim 1 wherein said inner frame elements include stiffening members extending longitudinally thereof.

3. The hollow core door in accordance with claim 1 wherein said spacer means is secured to the inner surface of said other skin.

4. The hollow core door in accordance with claim 1 wherein there is a shoulder on the inner surface of said peripheral portion of said molding which abuts said one skin.

5. The hollow core door in accordance with claim 4 wherein said means securing said molding against said one skin includes adhesive between said shoulder and said one skin.

6. The hollow core door in accordance with claim 5 wherein said shoulder has a channel intermediate its width into which said adhesive may flow.

7. The hollow core door in accordance with claim 1 wherein said means securing said molding against said one skin includes resiliently deflectable clips on said body portion of said molding and extending outwardly of the periphery thereof and bearing upon the inner surface of said one skin.

8. The hollow core door in accordance with claim 1 wherein there is included means securing said molding to said inner frame elements.

9. The hollow core door in accordance with claim 8 wherein said means securing said molding to said inner frame elements is elongated fasteners extending through said molding and into said inner frame elements.

10. The hollow core door in accordance with claim 1 wherein there is included adhesive between said molding and said mirror securing them in assembly.

11. The hollow tore door in accordance with claim 1 wherein said body portion of said molding has and outer peripheral side surfaces, the other side surface overlying said one skin about said aperture and the inner side surface having a channel extending about its inner periphery in which said mirror is seated therein.

12. In a method for making a hollow core door having a mirror in one face thereof comprising:

(a) providing a hollow core door having a pair of skins and a perimeter frame with stiles and top and bottom rails, one of said skins having an aperture therein with its side margins spaced inwardly of said perimeter frame and the other of said skins providing a continuous surface, and elongated inner frame elements secured between said skins and between the margins of said aperture and said stiles;

(b) mounting a spacer member on said other of said skins within the margins of said aperture;

(c) securing a mirror having dimensions smaller than those of said aperture in a peripheral molding, said molding having a peripheral portion providing a shoulder extending about the periphery of its outer side;

(d) placing said molding and mirror in said aperture with said shoulder abutting the outer surface of said one skin about said aperture; and (e) securing said molding against said one skin of said door.

13. The method of making a hollow core door in accordance with claim 12 in which said step of securing said molding against said one skin includes providing an adhesive between said peripheral shoulder and said one skin.

14. The method of making a hollow core door in accordance with claim 12 wherein said providing step includes providing an adhesive on surfaces of said inner frame elements bonding said elements to at least one of said skins.

15. The method of making a hollow core door in accordance with claim 12 wherein said step of securing said mirror in said molding includes placing an adhesive between the peripheral portion of said mirror and said molding to bond said mirror to said molding.

* * * * *

UNITED STATES PATENT AND TRADEMARK OFFICE

CERTIFICATE OF CORRECTION

PATENT NO. : 5,560,168
DATED : October 1, 1996
INVENTOR(S) : Robert J. Gagne et al.

It is certified that error appears in the above-identified patent and that said Letters Patent is hereby corrected as shown below:

Column 6,
Line 9, delete "of said pair of skins"
Line 10, delete "mirrored" and insert -- hollow core --.
Line 44, after "has" insert -- inner --.
Line 48, delete "therein"

Signed and Sealed this

Twenty-eighth Day of October, 2003

JAMES E. ROGAN
*Director of the United States Patent and Trademark Office*